US005598714A

United States Patent [19]

Strout et al.

[11] Patent Number: 5,598,714

[45] Date of Patent: Feb. 4, 1997

[54] METHOD AND APPARATUS FOR SEPARATION OF REFRIGERANT FROM A PURGE GAS MIXTURE OF REFRIGERANT AND NON-CONDENSIBLE GAS

[75] Inventors: D. Wayne Strout; Thomas L. Crandall, both of York, Pa.

[73] Assignee: RTI Technologies, Inc., York, Pa.

[21] Appl. No.: 529,648

[22] Filed: Sep. 18, 1995

Related U.S. Application Data

[63] Continuation-in-part of Ser. No. 401,263, Mar. 9, 1995, Pat. No. 5,570,590, which is a continuation of Ser. No. 19,659, Feb. 19, 1993, abandoned.

[51] Int. Cl.[6] ..... F25B 43/04

[52] U.S. Cl. ..... 62/85; 62/195; 62/292; 62/475

[58] Field of Search ..... 62/85, 77, 292, 62/149, 195, 475

[56] References Cited

U.S. PATENT DOCUMENTS

| | | | |
|---|---|---|---|
| 1,636,512 | 7/1927 | Hilger . | |
| 3,145,544 | 8/1964 | Weller . | |
| 3,777,509 | 12/1973 | Muench . | |
| 4,169,356 | 10/1979 | Kingham . | |
| 4,304,102 | 12/1981 | Gray . | |
| 5,005,369 | 4/1991 | Manz et al. | 62/195 |
| 5,078,756 | 1/1992 | Major et al. . | |
| 5,094,087 | 3/1992 | Gramkow . | |
| 5,241,837 | 9/1993 | Albertson, III | 62/475 |
| 5,261,246 | 11/1993 | Blackmon et al. | 62/475 |
| 5,377,501 | 1/1995 | Muston . | |

*Primary Examiner*—John M. Sollecito

*Attorney, Agent, or Firm*—Antonelli, Terry, Stout & Kraus, LLP

[57] ABSTRACT

A method and apparatus are disclosed for separation of non-condensible gas from recovered refrigerant collected in a collector tank. Non-condensible gas is intermittently vented from the collector tank. The vented non-condensible gas is directed to an accumulator which processes the vented non-condensible gas in a manner which allows gravity separation of the non-condensible gas from refrigerant liquid and vapor which may be mixed therewith in the vented gas from the collector tank. The gravity separated non-condensible gas and refrigerant in the accumulator are removed from the accumulator through respective outlets in the accumulator. The refrigerant is recycled in a refrigerant recovery apparatus and the gravity separated non-condensible gas is released to the atmosphere. The method and apparatus reduce release of refrigerant to the atmosphere as a result of venting of the collector tank.

15 Claims, 4 Drawing Sheets

METHOD AND APPARATUS FOR SEPARATION OF REFRIGERANT FROM A PURGE GAS MIXTURE OF REFRIGERANT AND NON-CONDENSIBLE GAS

RELATED APPLICATIONS

This application is a continuation in part of application Ser. No. 08/401,263, filed Mar. 9, 1995, now U.S. Pat. No. 5,570,590, which in turn is a continuation of application Ser. No. 08/019,659, filed Feb. 19, 1993, and now abandoned.

FIELD OF THE INVENTION

The present invention is directed to a method and apparatus for separation of refrigerant from a purge gas mixture of refrigerant and non-condensible gas.

BACKGROUND OF THE INVENTION

Refrigerant recovered from refrigeration systems must be reprocessed with little or no release of the refrigerant to the atmosphere. In systems for purifying and reclaiming of refrigerant, in particular by emptying or renewal of old refrigeration systems, it is relevant to collect the volatile liquid, e.g. R-12, R-22 and R-134A, upon the refrigerant being brought from its gaseous phase to its liquid phase in a condenser, such that the collected refrigerant may be reused.

In principle, the condensate may be filled into a collector tank without the latter having to be vented, because the vapor or gas of the condensate in the upper tank space will maintain its gas pressure also when this space is narrowed by the progressive charging of liquid condensate into the tank. As the condensate rises in the tank the gas will diffuse or condense down into the liquid, such that the gas pressure above the liquid will remain constant when the temperature is constant. Normally, however, there will occur a certain separation of non-condensible gas, mainly of atmospheric air, and as the tank is filled this gas will give rise to increased pressure in the tank concurrently with a further pressure built-up due to the separation of non-condensible gas from the currently introduced condensate.

Non-condensible gas must be separated from the recovered refrigerant as one of the purity requisites of recycled refrigerant. The increased pressure caused by the non-condensible gas also gives rise to some problems, e.g. an increase of the condensation pressure, whereby more energy is needed for the condensation of the volatile liquid and if the collector tank is to be utilized just reasonably effectively, i.e. to be nearly filled for collecting reasonably large portions of the condensate, ready for delivery, then it is in practice imperative to carry out from time to time, a blowing off of the non-condensible gas from the tank.

It is well known that this can be done based on the use of a pressure switch controlled blow-off valve at the top of the tank for automatically initiating blowing off when the pressure in the tank has risen to a predetermined maximum. The blowing off can be interrupted when the pressure has decreased suitably optionally controlled by the hysteresis of the pressure switch. Such a pressure switch is disclosed in U.S. Pat. No. 5,467,608, the disclosure of which is hereby incorporated by reference.

However, the blowing off itself gives rise to problems in that along with the letting out or purging of the non-condensible gases, in the following named air, a certain amount of condensible refrigerant gas will inevitably be expelled. From an environmental point of view, this is very undesirable in the case of a release of considerable amounts of refrigerant gas originating from the refrigerants R-12 and R-22, for example, which have a decomposing effect on the ozone layer around the planet. Such a co-outflow of the condensible gas is particularly noticeable when the temperature is relatively high, because the concentration with the pressure contribution of the condensible gas will then be relatively high in the collector tank.

This circumstance is made even worse by the fact that during the opening time of the blow-off valve the pressure in the collector tank will be reduced such that the condensate will evaporate further, whereby towards the end of the blow-off period there will occur a further increased content of the condensible gas in the purge gas mixture of the blow-off product. Thus, the process for separating of non-condensible gas from the recovered refrigerant must minimize simultaneous release of refrigerant during the venting of non-condensible gas to the atmosphere.

A possible solution to this problem resides in mounting a cooler element in connection with a blow-out pipe from the collector tank, such that the exhausted gas will generally be cooled to the condensation temperature of the condensible gas, whereby the critical fraction of the gas is condensed and falls back into the tank without getting out to the atmosphere. However, experiments have shown that in practice this solution is unrealisticly expensive for it to be reasonably effective, since during the relatively brief blow-out periods a particularly intensive heat exchange with the blow-out gases must take place. There is a need for an improved method and apparatus for recovering/recycling refrigerant wherein the venting of non-condensible gas particularly air, from the collector tank can be carried out while reducing or minimizing the amount of condensible gas that will be expelled to the environment by way of the purge gas.

SUMMARY OF INVENTION

An object of the present invention is to provide an improved method and apparatus for purging refrigerant and collecting the purged refrigerant which more closely control the amount of refrigerant released during the venting of non-condensible gas from the collected, purged liquid to provide higher efficiencies in recovery and recycling of refrigerant. Further, an object of the present invention is to provide an improved method and apparatus for separation of non-condensible gas from recovered refrigerant in a more environmentally safe manner, minimizing the simultaneous release of refrigerant during venting of non-condensible gas to the atmosphere.

These and other objects are attained by the method of the invention for separation of non-condensible gas from refrigerant recovered from a refrigerant system, wherein the method comprises collecting refrigerant recovered from a refrigerant system in a collector tank, intermittently blowing-off non-condensible gas from the collector tank which has separated from the refrigerant in the collector tank, directing the non-condensible gas in the blow-off gas from the collector tank to an accumulator wherein the non-condensible gas is processed in a manner which results in gravity separation of non-condensible gas from refrigerant liquid and vapor thereof mixed with the non-condensible gas in the blow-off gas from the collector tank, and removing the separated non-condensible gas and refrigerant liquid and vapor thereof through respective outlets in the accumulator. According to a disclosed, preferred embodiment of the method of the invention, the method further includes the step of controlling the removing of the separated non-condensible gas in the accumulator and the introduction of the gas blown off from the collector tank to the accumulator in accordance with the timing of the intermittent blowing-off of non-condensible gas from the collector tank.

The apparatus of the invention for separation of non-condensible gas from a refrigerant recovered from a refrigerant system, comprises a collector tank for collecting refrigerant recovered from the refrigeration system, a gas blow-off valve for intermittently blowing off non-condensible gas from the collector tank which has separated from the refrigerant in the collector tank, and an accumulator for receiving the blown-off gas from the collector tank via the gas blow-off valve. The accumulator includes means for causing gravity separation of non-condensible gas from refrigerant liquid and vapor thereof mixed with the non-condensible gas received from the collector tank by the accumulator. The accumulator also includes first and second outlets for respective outflow of gravity separated non-condensible gas and refrigerant liquid and vapor thereof which are separated from each other in the accumulator.

In the disclosed embodiment, a vent conduit is provided in communication with the first outlet of the accumulator for outflow of non-condensible gas from the accumulator. A vent valve is mounted in the vent conduit. Means are provided for controlling the vent valve for intermittent venting of the accumulator with the intermittent blow off of non-condensible gas from the collector tank. The vent conduit further includes a check valve therein to inhibit return flow through the vent conduit into the accumulator but not flow from the accumulator.

The accumulator includes an internal impingement plate which obstructs an incoming flow of non-condensible gas and volatile liquid and vapor which may be mixed therewith from the blowing off of gas from the collector tank and encourages separation of the volatile liquid and vapor from the non-condensible gas in the accumulator. The second outlet of the accumulator is communicated with an inlet circuit of an apparatus for purging the volatile liquid recovered from the refrigerant system and returning the purged volatile liquid to the collector tank. The means communicating the second outlet of the accumulator with this inlet circuit includes a fluid passage and a check valve in the passage to inhibit the flow through the fluid passage into the accumulator but not from the accumulator. A further feature of the invention is that the inlet and outlet circuits for fluid flow to and from the accumulator of the apparatus include capillary tubes for restricting the flow to permit a relatively controlled reaction of a means for intermittently blowing off non-condensible gas from the collector tank.

An apparatus for purging refrigerant and collecting the purged refrigerant in a collector tank according to the invention comprises an inlet for receiving refrigerant, a collector tank, a condenser unit in a delivery connection with the collector tank; a purging system arranged in an in-line connection between the inlet and the condenser unit and operable to deliver purged refrigerant in a gaseous phase to the condenser unit and a gas blow-off valve mounted in a blow-off conduit connected with the top of the collector tank. The gas blow off valve is controllable in dependence upon condensate vapor pressure in the collector tank to effect an intermittent blow-off of non-condensible gas separated from the condensate. The control is by means for at least one of measuring or indicating a differential pressure between the actual condensate vapor pressure of the condensed liquid and a total gas pressure in the collector tank, with the valve being opened when a total pressure exceeds the condensate vapor pressure by a predetermined value. The apparatus further includes an accumulator of the aforementioned type for receiving the blow-off gas from the collector tank via the blow-off conduit when the gas blow-off valve is opened. As noted above, the accumulator is configured to permit gravity separation of non-condensible gas from volatile liquid refrigerant and vapor thereof mixed with a non-condensible gas in the blow-off gas received in the accumulator from the collector tank. First and second outlets are provided in the accumulator for respective outflow of separated non-condensible gas and refrigerant.

These and other objects, features and advantages of the present invention will be more apparent from the following detailed description of disclosed embodiments of the invention taken with the accompanying drawings.

DETAILED DESCRIPTION OF EMBODIMENTS

Figure 1:
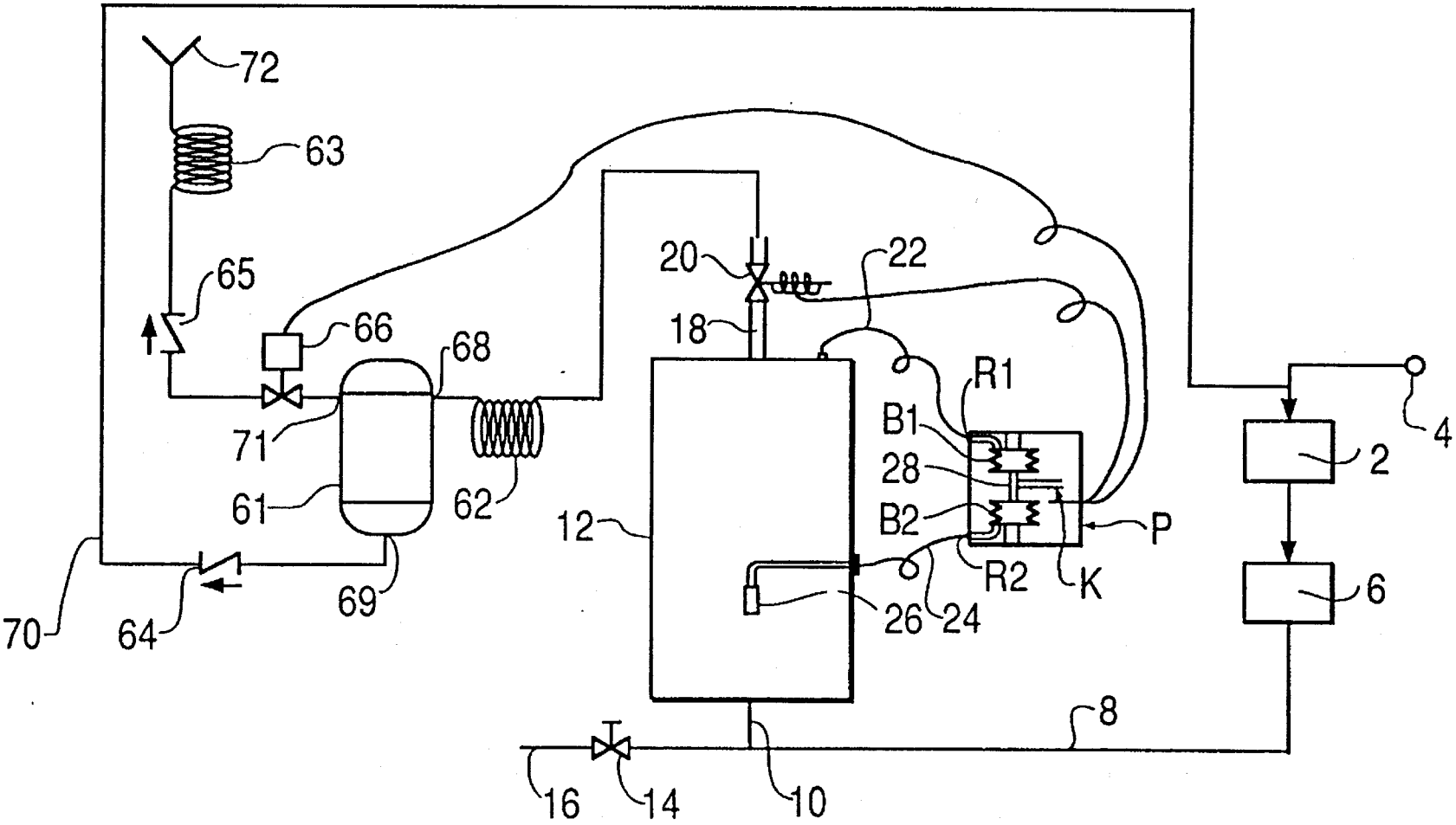
FIG. 1 is a schematic view for illustration of the invention.
Figure 5:
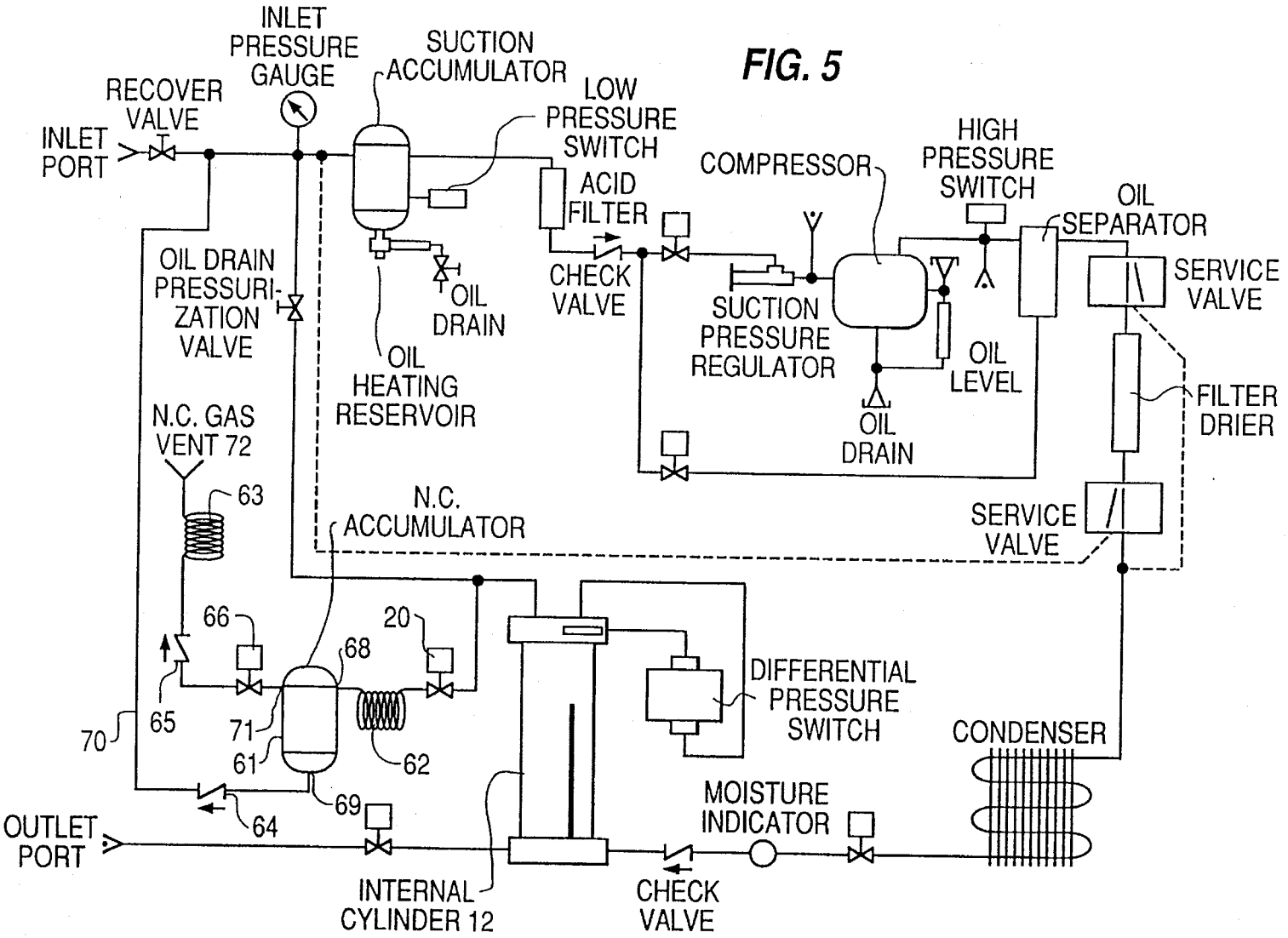

FIG. 1 illustrates an apparatus of the invention for purging volatile liquids, particularly refrigerant, and collecting the refrigerant in a collector tank and separating non-condensible gas from the recovered refrigerant so as to minimize release of the purged liquid during venting of non-condensible gas to the atmosphere. More particularly, in FIG. 1 there is indicated a purification system 2 for refrigerant supplied from a source 4, e.g. the refrigeration system of a case to be scrapped. In the system 2 the refrigerant will be cleaned for different substances, mainly water, but not for non-condensible gases, and the refrigerant, in gaseous phase, is delivered to a condenser 6, from which the condensate is conveyed further through a conduit 8 to a connector stub 10 at the bottom of a collector tank 12. The bottom stub 10 is also, through a valve 16, connected with a discharge conduit 16. Details of the system 2 are shown in FIG. 5.

The tank 12 at its top, has a blow-out pipe 18 provided with a valve 20, viz. a solenoid valve controlled by a pressostat P. The latter is a differential pressostat, which, through a switch K, controls the opening and closing of the valve 20 in dependence of a pressure applied to a connector stub R1 being higher or lower than a pressure applied to another connector stub R2. Through a conduit 22 the connector stub R1 is connected directly with the space inside the tank, while the connector study R2, through a conduit 24, is connected with a capsule 26 inside the tank.

The capsule 26 is filled with a liquid that is widely equivalent or identical with the condensate liquid in its pure condition, e.g. one of the refrigerants R-12, R-22 or R-134A, and it will thus be the vapor pressure from this clean liquid that will be transferred to the input stub R2 of the pressostat. To the stub R1 will be transferred the total pressure in the tank 12, i.e. the vapor or gas pressure both from the condensate in the tank at the same temperature and from the further pressure source constituted by the non-condensible gas and the air as separated from the condensate, mainly atmospheric air. This air is compressed all according to the raising of the liquid level in the tank, so it will provide for a relatively increasing pressure on the input stub R1.

Inside the pressostat P the input stub R1 is connected to a bellow B1, which, through a rod 28, exerts a pressure on another bellow B2 connected to the stub R2. The switch K is controlled by the rod 28, such that the switch will be closed and cause the blow-off valve 20 to open, when the overpressure from the separated air in the tank 12 reaches a certain, preset value. The pressostat exhibits a certain hysteresis, such that the valve 20 will not be closed until after a noticeable pressure drop in the tank 12 and thereafter will not be reopened until after a following noticeable increase of the pressure in the tank. Therefore, with a suitable adjustment of the pressostat it is possible to achieve quite ideal conditions for the discussed blow-off of the air without any compromising blow-off of condensible gas. However, a certain associated blow-off of the latter will be inevitable, even with a correctly adjusted system. According to the invention this blow-off gas is subjected to a separation process after being vented from the collector tank 12 to lower even further the amount of refrigerant released to the atmosphere by this venting.

The amount of refrigerant released during the venting process is more closely controlled, resulting in higher efficiencies for total recycled refrigerant, according to the invention by conveying the blow-off gas from the collector tank 12 to and through a circuit comprising a non-condensible gas accumulator 61, capillary tubes 62 and 63, check valves 64 and 65 and solenoid valves 20 and 66.

The accumulator 61 is provided with an internal impingement plate 67 for enhancing the efficiency of separation of the non-condensible gas from refrigerant in the accumulator 61. Refrigerant, being heavier than non-condensible gas, tends to settle to the bottom of the accumulator 61. The impingement plate 67 obstructs the flow of the non-condensible gas/refrigerant mixture entering the accumulator through inlets 68 downstream of capillary tube 62 and further encourages refrigerant to be separated from the non-condensible gas.

The capillary tubes 62 and 63 on the inlet and outlet circuits of the accumulator 61 restrict the flow permitting more controlled reaction of the differential pressure switch K to changes in pressure. The solenoid valves 20 and 66 in series with these capillary tubes stop and start flow as controlled by the differential pressure switch K.

The access port or outlet 69 at the bottom of the accumulator 61 is connected to the inlet circuit of the recovery/recycling purification system 2 as shown in FIG. 1. In particular, return line 70 for the outlet 69 returns the separated refrigerant from accumulator 61 to a location upstream of a suction accumulator of the system 2 is illustrated in FIG. 5. During a venting cycle for venting the blow-off gas from the collector tank 12, the return line 70 returns the refrigerant from the accumulator to the suction accumulator where it is reprocessed and further purified by the system. The check valves 64 and 65 are employed to inhibit reverse flow into the accumulator 61.

The operation of the non-condensible gas accumulator circuit is as follows. When a typical recover/recycle procedure is started, the non-condensible gas accumulator 61 will be at, or slightly below atmosphereic pressure. When the differential pressure switch K in the collector tank 12 initially activates, the flow of non-condensible gas and refrigerant mixture is in the blow-off gas from the tank 12 flowing into the accumulator 61 via the capillary tube 62 and solenoid valve 20. As the incoming mixture hits the impingement plate 67, the refrigerant and non-condensible gas will tend to separate. Due to the relatively large volume of accumulator 61 and the relatively low flow rate, very little, if any flow will occur through the outlet 71 towards the inlet side of the purification system 2 or through solenoid valve 66 to the non-condensible gas vent 72.

During the time between the first and second venting cycles,, the contents of the accumulator 61 through gravity and condensation, will begin to separate. Refrigerant will setttle to the bottom and non-condensible gas will rise to the top. When subsequent venting cycles for the internal cylinder/collector tank 12 occur, the non-condensible gas at the top of the accumulator 61 will be vented through solenoid 66 and the capillary tube 63 to the atmosphere by way of vent 72. Proper sizing of the capillary tube will limit flow to an acceptable level. In the disclosed embodiment, the volume of the accumulator 61 is approximately 30 in.$^3$ and the capillary tubes 62 and 63 each have a inside diameter of 0.060 inch and a length of approximately 16 inches. Refrigerant at the bottom of the accumulator 61 will be forced to the end of the suction accumulator of the purification system 2 and reprocessed through the system as noted above.

Figure 4:
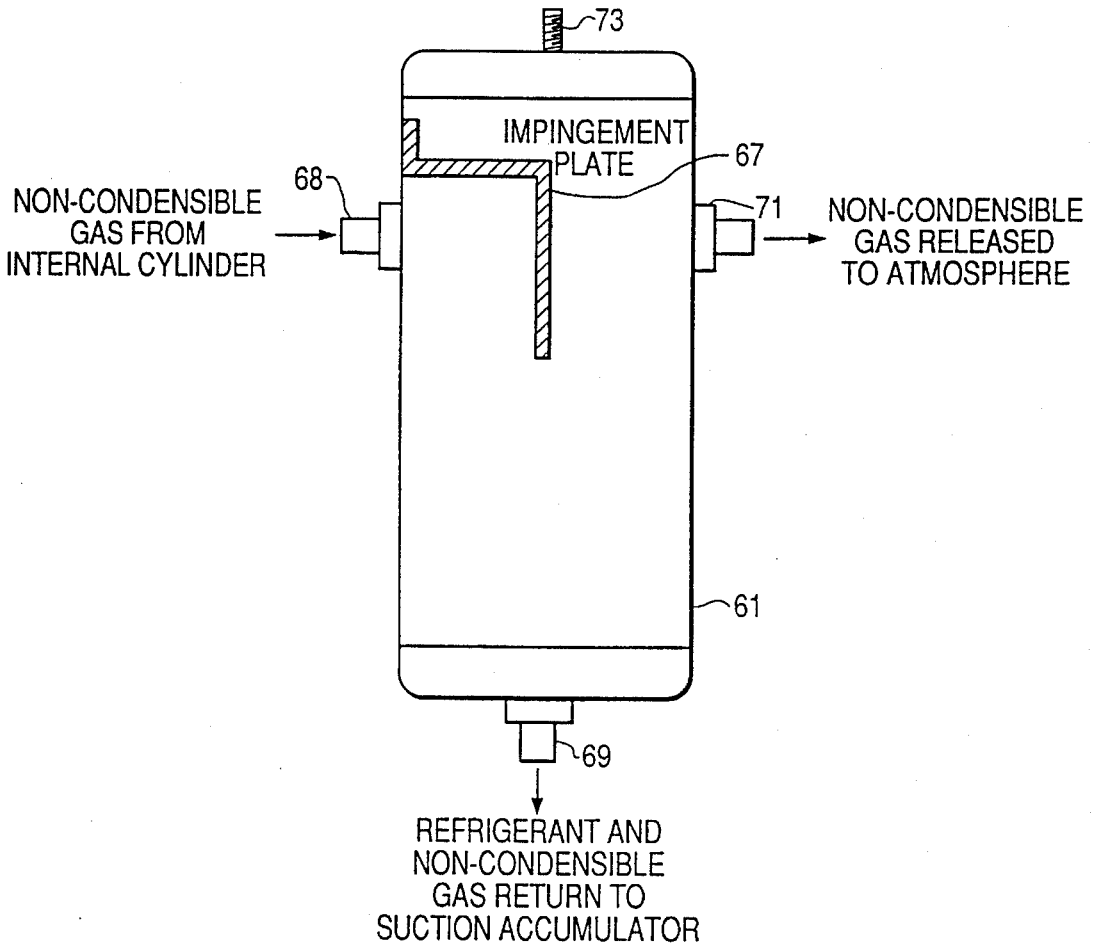
FIG. 4 is a cross sectional view of the non-condensible gas accumulator of the invention and FIG. 5 is a schematic view of the preferred embodiment showing additional details of the purification system.

In the disclosed embodiment, the accumulator 61 is a cylindrical metal vessel with integral interior mounted impingement plate 67. The accumulator is provided with one inlet 68 and two outlet ports, 69 and 71, which allow connection to the supporting circuitry referred to above. A mounting stub 73, FIG. 4 on top of the accumulator permits mounting to the main frame of the recovery machine. The inlet capillary tube 62 is connected to the inlet 68 of the accumulator 61 downstream of the solenoid valve 20. The outlet capillary tube 63, after solenoid valve 66 is connected to the vent 72 for the accumulator 61. The apparatus and method of the invention permit the closer control of the amount of refrigerant, at least during the venting process and result in higher proficiencies for totaled recycled refrigerant.

Figure 2:
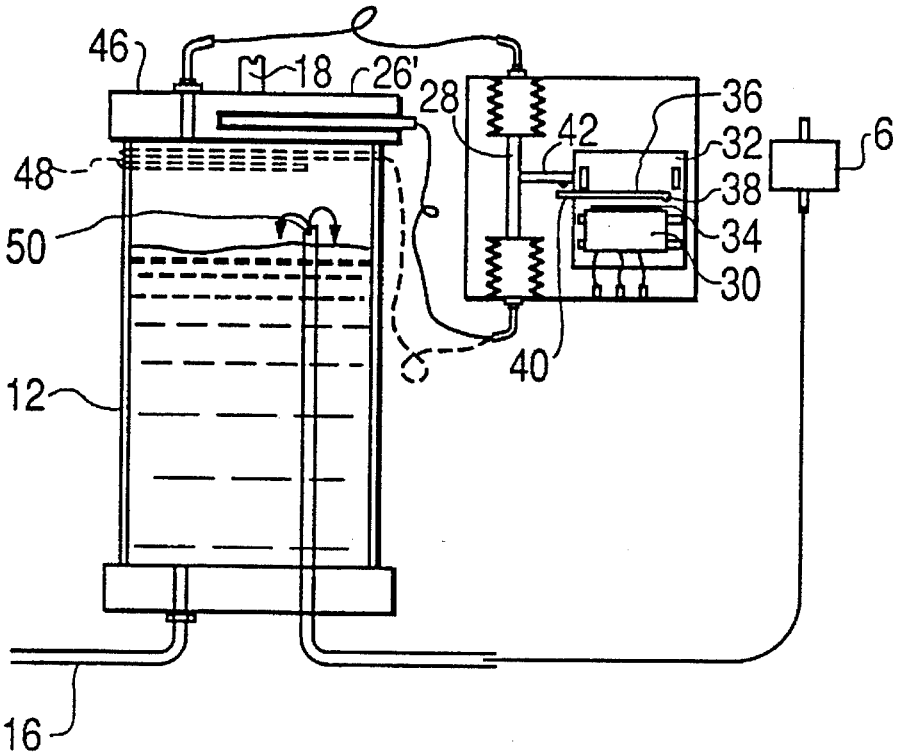
FIG. 2 is a more detailed view of a portion of a preferred form of an apparatus according to the invention.

In the embodiment shown in FIG. 2 it is illustrated by way of example that the switch K is a micro switch 30, which is mounted on a carrier plate 32 and has an actuation knob 34 that is depressible for operating the switch by means of a pivot arm 36 hinged at 38 and having a free end portion 40, which is depressible by a side cam 42 on the connector rod 28 between the bellows B1 and B2. By an adjustment of the carrier plate 32 upwardly or downwardly it will then be possible to adjust the level of the differential pressure to which the pressostat responds, and by adjusting the switch 30 horizontally on the carrier plate 32 an adjustment of the hysteresis function of the pressostat, given by the larger or smaller distance between the switch cam 34 and the pivot axis of the switch arm 36, will be effected. Thus, the pressostat will be adjustable to different optimized manners of reaction.

The capsule 26, which in FIG. 1 is shown located inside the tank, is in FIG. 2 shown located in a bore in a tank head block 46 of aluminum or a correspondingly well heat conducting material, whereby this particular temperature/pressure sensor will be in close contact, in a constructively simple manner, with the operatively significant area of the tank, viz. the upper blow-off area, the temperature of which will be decisive for the blow-off pressure. Alternatively, as shown by dotted lines, the sensor capsule or pocket 26' may be constituted by a capillary tube 48 wound about the upper end of the tank 12 in the heat conducting connection therewith. The capillary tube connections to the two input stubs of the pressostat should have approximately equal lengths.

The supply pipe for letting the condensate into the tank 12, according to FIG. 2 may have its mouthing 50 located at a relatively high level in the tank, whereby the supplied liquid during its introduction and following downfall gets good possibilities for separation of air and other non-condensible gases to be blown off later on.

Suitably the tank is filled up to only some 80% of its volume, e.g. as represented by the filling level shown in FIG. 2, with the supply mouthing 50 located slightly thereabove. By a still higher filling level there may tend to be an increased concentration of condensible gas in the blow-off product.

It should be mentioned that the aim of mounting, as in FIG. 2, the sensor pocket 26' in indirect contact with the tank chamber is to achieve that the sensor will not react to sudden, brief temperature variations in the supplied condensate, but rather react to the present average temperature. With the use of the capillary tube 48 wound about the tank a heat insulation should be arranged at the outside.

Figure 3:
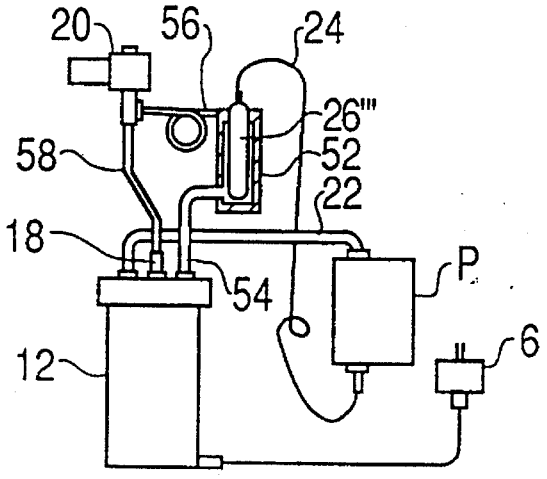
FIG. 3 is a similar view of a portion of a modified embodiment.

FIG. 3 shows a modified system, having the same main units 6, P and 12 as in FIGS. 1–2. In this embodiment the sensor capsule, here designated 26''', is mounted externally of the tank 12, housed in a housing 52, the lower end of which is in permanent connection with the top of the tank 12 through a pipe 54. The upper end of the housing 52 is connected to the inlet side of the blow-out valve 20 through a capillary pipe 56, which is thus connected to the valve 20 in parallel with the outlet stub 18 of the tank 12.

It is an important aspect of this embodiment that the tank 12 is an easily exchangeable unit, which can be shifted or replaced whenever it is filled, while the housing 52 with the sensor 26''' can remain as a stationary unit in the reclaiming apparatus.

The external arrangement of the housing 52 accounts for a less efficient temperature transfer between the tank 12 and the sensor 26''' within the housing 52, but advantage is taken of the Freon gases themselves being well heat-conductive, such that through the relatively wide pipe or hose 54 the temperature of the gas in the tank 12 will be transferred to the housing 52 and thus to the sensor 26'''.

Preferably the housing 52 is made of a material having good heat conducting properties, such that the sensor 26''' is subjected to substantially the same temperature all over its length. The housing 52 may be externally heat insulated in order to promote this effect.

The capillary tube 56 between the top of the housing 52 and the inlet end of the valve 20 will result in a certain throughflow of the gas in the housing 52 every time the valve 20 is opened. Hereby the gas in the housing 52 will be replaced by "fresh gas" from the container 12, whereby the temperature of the sensor 26''' will be adjusted accordingly. In typical cases such adjustments will take place with intervals of few minutes only, such that generally the temperature of the housing 52 and therewith of the sensor 26''' will be the same as the temperature in the upper end of the tank 12, just as desirable.

The conduit between the outlet stub 18 and the valve provided as a capillary tube 58, which will promote a slow and well controlled blowout of the gas.

Of course, all of the pipes or hoses communicating with the tank 12, including the pipe or hose 54, should be easily releasable arranged in order to enable the tank 12 to be easily shiftable.

As mentioned, the sensor pocket should contain the same liquid as the condensate in its pure state, this providing for the highest degree of optimizing of the blow-off function. This, however, will not exclude that a slightly deviating liquid be used, if according to experience it will provide for a result with a desired, sufficient degree of optimizing. Besides, with the embodiment according to FIG. 1 it will be relatively easy to readjust the device to the handling of another liquid, because the sensor pocket and its connection to the pressostat will be easy to replace by a corresponding set containing the new liquid.

The invention, of course, will also comprise a system or unit, in which the blow-off valve 20 is controlled manually, when the pressostat is alternatively used for a suitable signalling, e.g. by the switch K operating to control the operation of a signal lamp.

The manual operation of the blow-off valve 20 also results in a connection of solenoid valve 66 for allowing flow into and out of the accumulator 61.

While we have disclosed only several embodiments of the invention, the invention is not limited thereto but is susceptible to use in other forms without departing from the basic invention disclosed herein and claimed in appended claims, as will be apparent to the skilled artisan.

We claim:

1. An apparatus for purging refrigerant and collecting the purged refrigerant in a collector tank from which non-condensible gas is vented, the apparatus comprising:

an inlet for receiving refrigerant;

a collector tank;

a condenser unit in a delivery connection with said collector tank;

a purging system arranged in an in-line connection between said inlet and said condenser unit and operable to deliver purged refrigerant in a gaseous phase to said condenser unit;

a gas blow-off valve mounted in a blow-off conduit connected with the collector tank, said gas blow-off valve being controllable in dependence upon condensate vapor pressure in the collector tank to effect an intermittent blowing off of non-condensible gas separated from the condensate in said collector tank, wherein the gas blow-off valve is controllable by means for at least one of measuring or indicating a differential pressure between the actual condensate vapor pressure of the condensed refrigerant and a total gas pressure in the collector tank, and said valve is adapted to be opened when a total gas pressure exceeds the condensate vapor pressure by a predetermined value; and an unheated accumulator for receiving the blow-off gas from said collector tank via said blow-off conduit and an inlet in said accumulator when said gas blow-off valve is opened, said accumulator being configured to permit gravity separation of non-condensible gas from refrigerant liquid and vapor mixed with said non-condensible gas in the blow-off gas received in said accumulator from said collector tank, first and second outlets being provided in said accumulator for respective outflow of gravity separated non-condensible gas and refrigerant from said accumulator,and wherein means are provided for communicating said second outlet with an inlet circuit of said apparatus for recycling refrigerant from said accumulator.

2. The apparatus according to claim 1, further comprising a vent conduit in communication with said first outlet of said accumulator for outflow of non-condensible gas from said accumulator.

3. The apparatus according to claim 2, further comprising a vent valve mounted in said vent conduit, and means controlling said vent valve for venting of said accumulator through said vent conduit during the blowing-off of non-condensible gas from said collector tank.

4. The apparatus according to claim 3, wherein said vent conduit further includes a check valve in said vent conduit to inhibit flow through said vent conduit to said accumulator but not from said accumulator.

5. An apparatus for purging refrigerant and collecting the purged refrigerant in a collector tank from which non-condensible gas is vented, the apparatus comprising:

an inlet for receiving refrigerant;

a collector tank;

a condenser unit in a delivery connection with said collector tank;

a purging system arranged in an in-line connection between said inlet and said condenser unit and operable to deliver purged refrigerant in a gaseous phase to said condenser unit;

a gas blow-off valve mounted in a blow-off conduit connected with the collector tank, said gas blow-off valve being controllable in dependence upon condensate vapor pressure in the collector tank to effect an intermittent blowing off of non-condensible gas separated from the condensate in said collector tank, wherein the gas blow-off valve is controllable by means for at least one of measuring or indicating a differential pressure between the actual condensate vapor pressure of the condensed refrigerant and a total gas pressure in the collector tank, and said valve is adapted to be opened when a total gas pressure exceeds the condensate vapor pressure by a predetermined value; and an accumulator for receiving the blow-off gas from said collector tank via said blow-off conduit when said gas blow-off valve is opened, said accumulator being configured to permit gravity separation of non-condensible gas from refrigerant liquid and vapor mixed with said non-condensible gas in the blow-off gas received in said accumulator from said collector tank, first and second outlets being provided in said accumulator for respective outflow of gravity separated non-condensible gas and refrigerant from said accumulator, wherein said accumulator includes an internal impingement plate which obstructs an incoming flow of blow-off gas and encourages separation of refrigerant and non-condensible gas mixed in said blow-off gas.

6. The apparatus according to claim 1, wherein said means for communicating includes a fluid passage and a check valve in said fluid passage to inhibit the flow through said fluid passage into the accumulator but not from said accumulator.

7. An apparatus for purging refrigerant and collecting the purged refrigerant in a collector tank from which non-condensible gas is vented, the apparatus comprising:

an inlet for receiving refrigerant;

a collector tank;

a condenser unit in a delivery connection with said collector tank;

a purging system arranged in an in-line connection between said inlet and said condenser unit and operable to deliver purged refrigerant in a gaseous phase to said condenser unit;

a gas blow-off valve mounted in a blow-off conduit connected with the collector tank, said gas blow-off valve being controllable in dependence upon condensate vapor pressure in the collector tank to effect an intermittent blowing off of non-condensible gas separated from the condensate in said collector tank, wherein the gas blow-off valve is controllable by means for at least one of measuring or indicating a differential pressure between the actual condensate vapor pressure of the condensed refrigerant and a total gas pressure in the collector tank, and said valve is adapted to be opened when a total gas pressure exceeds the condensate vapor pressure by a predetermined value; and an accumulator for receiving the blow-off gas from said collector tank via said blow-off conduit when said gas blow-off valve is opened, said accumulator being configured to permit gravity separation of non-condensible gas from refrigerant liquid and vapor mixed with said non-condensible gas in the blow-off received in said accumulator from said collector tank, first and second outlets being provided in said accumulator for respective outflow of gravity separated non-condensible gas and refrigerant from said accumulator, wherein inlet and outlet circuits for fluid flow to and from said accumulator include capillary tubes for restriction of the flow to permit a relatively controlled reaction of said means for at least one of measuring or indicating a differential pressure between the actual condensate vapor pressure of the condensed liquid refrigerant and a total gas pressure in the collector tank.

8. An apparatus for separation of refrigerant from a purge gas mixture of refrigerant and non-condensible gas recovered from a refrigeration system, said apparatus comprising a collector tank for collecting refrigerant recovered from said refrigeration system, a gas blow-out pipe connected to said collector tank with a blow-off valve therein for intermittently venting non-condensible gas from the collector tank which has separated from the refrigerant in said collector tank, and an unheated accumulator in communication with said blow-out pipe via an inlet in said accumulator for receiving the blow-off gas from said collector tank which is intermittently vented from said collector tank via said gas blow-off valve, said accumulator further including means for causing gravity separation of non-condensible gas from refrigerant liquid and vapor thereof mixed with said non-condensible gas in the blow off gas received in said accumulator, and first and second outlets in said accumulator for respective outflow of gravity separated non-condensible gas and refrigerant from said accumulator, a vent conduit being provided in communication with said first outlet of said accumulator for outflow of non-condensible gas from said accumulator, a vent valve being mounted in said vent conduit, and means controlling said vent valve for intermittent venting of said accumulator with said intermittent actuation of said blow-off valve for blowing-off of non-condensible gas from said collector tank.

9. The apparatus according to claim 8, wherein said vent conduit further includes a check valve in said vent conduit to inhibit flow through said vent conduit into said accumulator but not from said accumulator.

10. An apparatus, for separation of refrigerant from a purge gas mixture of refrigerant and non-condensible gas recovered from a refrigeration system, said apparatus comprising a collector tank for collecting refrigerant recovered from said refrigeration system, a gas blow-off valve for intermittently venting non-condensible gas from the collector tank which has separated from the refrigerant in said collector tank, and an accumulator for receiving the blow-off gas from said collector tank which is intermittently vented from said collector tank via said gas blow-off valve, said accumulator including means for causing gravity separation of non-condensible gas from refrigerant liquid and vapor thereof mixed with said non-condensible gas in the blow off gas received in said accumulator, and first and second outlets in said accumulator for respective outflow of gravity separated non-condensible gas and refrigerant from said accumulator, a vent conduit being provided in communication with said first outlet of said accumulator for outflow of non-condensible gas from said accumulator, a vent valve being mounted in said vent conduit, add means controlling said vent valve for intermittent venting of said accumulator with said intermittent blowing-off of non-condensible gas from said collector tank, wherein said means for causing gravity separation includes an internal impingement plate which obstructs an incoming flow of blow-off gas from said collector tank and encourages separation of non-condensible gas and refrigerant in said blow-off gas.

11. The apparatus according to claim 8, further comprising means for communicating said second outlet of said accumulator with an inlet circuit of means for purging recovered refrigerant and delivering the same to said collector tank.

12. The apparatus according to claim 11, wherein said means for communicating includes a fluid passage and a check valve in said fluid passage to inhibit flow through said fluid passage into the accumulator but not from said accumulator.

13. An apparatus, for separation of refrigerant from a purge gas mixture of refrigerant and non-condensible gas recovered from a refrigeration system, said apparatus comprising a collector tank for collecting refrigerant recovered from said refrigeration system, a gas blow-off valve for intermittently venting non-condensible gas from the collector tank which has separated from the refrigerant in said collector tank, and an accumulator receiving the blow-off gas from said collector tank which is intermittently vented from said collector tank via said gas blow-off valve, said accumulator including means for causing gravity separation of non-condensible gas from refrigerant liquid and vapor thereof mixed with said non-condensible gas in the blow off gas received in said accumulator, wherein inlet and outlet circuits for fluid flow to and from said accumulator include capillary tubes for restricting the flow to permit a relatively controlled flow to and from said accumulator.

14. A method for separation of non-condensible gas from refrigerant which has been recovered from a refrigerant system, comprising collecting refrigerant recovered from a refrigerant system in a collector tank, said refrigerant containing non-condensible gas as an impurity, blowing off non-condensible gas from the collector tank which has separated from the refrigerant in said collector tank, directing the blow off gas, which may contain at least small amounts of refrigerant liquid and vapor mixed with non-condensible gas, to an unheated accumulator by way of a valved collector tank blow-out pipe and processing the blow off gas in the accumulator in a manner which allows gravity separation of refrigerant liquid and vapor in the blow off gas from the non-condensible gas in the blow off gas, and removing the separated non-condensible gas and refrigerant in the accumulator through respective outlets in said accumulator while said blow-off gas is directed to said accumulator through said valved blow-out pipe.

15. The method according to claim 14, wherein said blowing off of non-condensible gas from the collector tank is performed intermittently, and said method including controlling the removing from the accummulator of the separated non-condensible gas in said accumulator and the introduction of the blow off gas from the collector tank to said accumulator in accordance with the timing of said blowing-off of non-condensible gas from said collector tank.

* * * * *